United States Patent [19]

Katz

[11] 3,998,558

[45] Dec. 21, 1976

[54] MECHANICAL PENCIL

[75] Inventor: Otto Katz, Schwabach, Germany

[73] Assignee: A.W.Faber-Castell, Stein near Nurnberg, Germany

[22] Filed: July 1, 1975

[21] Appl. No.: 592,252

Related U.S. Application Data

[62] Division of Ser. No. 423,476, Dec. 10, 1973, Pat. No. 3,922,098.

[30] Foreign Application Priority Data

Dec. 8, 1972 Germany ..... 2260065

[52] U.S. Cl. ..... 401/94

[51] Int. Cl.[2] ..... B43K 21/22

[58] Field of Search ..... 401/92–94, 401/65, 67

[56] References Cited

UNITED STATES PATENTS

| | | | |
|---|---|---|---|
| 654,722 | 7/1900 | Francis | 401/93 |
| 2,353,177 | 7/1944 | Moore | 401/65 |
| 2,473,149 | 6/1949 | Juelss | 401/63 |

FOREIGN PATENTS OR APPLICATIONS

| | | | |
|---|---|---|---|
| 1,103,083 | 5/1955 | France | 401/94 |
| 317,687 | 2/1919 | Germany | 401/93 |
| 464,199 | 7/1951 | Italy | 401/94 |
| 174,949 | 4/1923 | United Kingdom | 401/94 |

*Primary Examiner*—Lawrence Charles
*Attorney, Agent, or Firm*—Michael J. Striker

[57] ABSTRACT

A mechanical pencil of the collet action type is provided with a lead collet being formed from a pair of identically configured mating shells which are maintained in fixed relation with respect to one another by means of an annulus cooperating with a conical flared portion formed at one end thereof and by means of a cap at the opposite end, all parts of the pencil being maintained in assembled relation by a spring. The parts are assembled by sliding first one and then the other of the two collet shells through an annulus into mating relation with one another and thereafter fitting the end cap over the end of the mating shells.

4 Claims, 7 Drawing Figures

FIG. 4
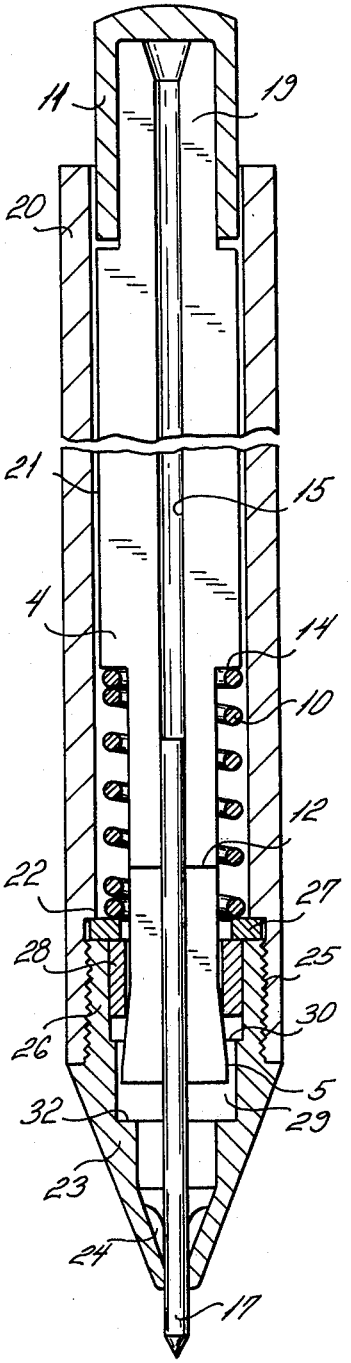
FIG. 5
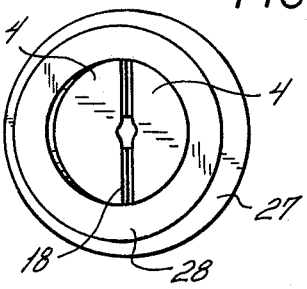
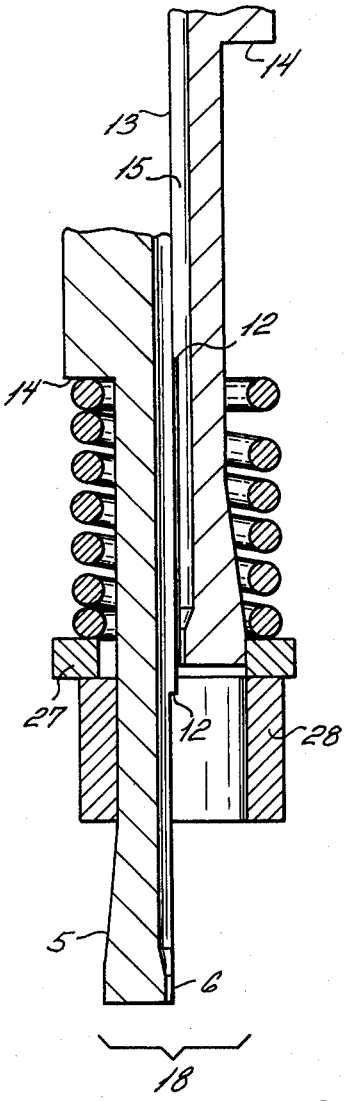
FIG. 6
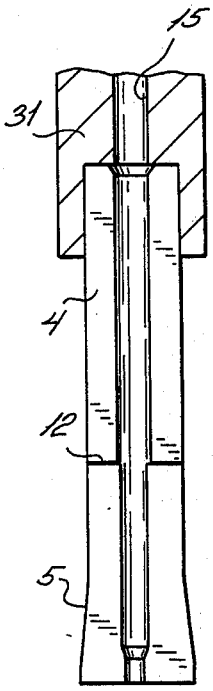
FIG. 7

MECHANICAL PENCIL

This is a division of application Ser. No. 423,476, filed Dec. 10, 1973, now U.S. Pat. No. 3,922,098, issued Nov. 25, 1975.

BACKGROUND OF THE INVENTION

The present invention is directed to a mechanical pencil of the collet action type wherein a shiftable lead is carried within a collet which collet member is held in lead gripping relation by the effect of a compression spring and which is movable in opposition to the bias of the spring to cause the lead to be moved extensibly from the collet.

In the case of such types of mechanical pencils where the collet member is closed by the action of a spring and which are designed to be operated by means of a depressable push button opposing the bias of the spring, the lead has to be held firmly even after frequent releasing of the collet member so that with sufficient safety the individual's firm writing pressure can be absorbed without the shifting of the lead. It is desirable that the collet member clamping effect be achieved with as little prestress of the spring as is reasonably possible and with a low spring constant in order to facillitate the operation of the depressable push button.

It has heretofore been known to construct collets of metal for fulfilling these requirements and such metal collet members are generally slotted several times at their circumference and have a thread at their far end to receive the lead guiding tube whereby simultaneously a contact surface for the compression spring is formed which causes the clamping force to be exerted at the collets. In order to achieve a precise application of the clamping jaws of the collet evenly at the circumference of the lead, in most cases three slots are provided in such metal collets. In addition, the clamping jaws are generally roughened in the area of the surfaces which are provided for contact with the lead or they are rendered particularly gripping by cutting of threads having a left or right hand pitch. This type of collet member has proven quite effective in the past. However, such types of collet members have the disadvantage of requiring a considerable amount of assembly work and precise machining and are consequently relatively expensive to manufacture. While such mechanically pencils are generally of high quality and are salable in particular markets (such as for use in the making of professional drawings) these pencils are generally too high priced to be used in the general market and particularly in the student market.

SUMMARY OF THE INVENTION

It has therefore been found desirable to provide a collet action type pencil which can be inexpensively mass produced and which will still provide the highly advantageous operating characteristics of the former metal collet type pencils already well known in the market. It has however been found that it is not practical to simply form the collet member parts formerly made from metal of a thermo plastic material since, for instance, the slots between the collet jaws which are necessary for opening and closing of the jaws can be produced only with the greatest difficulty in any injection molding process and the very high precision of the shaping tools which would be required for this purpose on the one hand would cause high cost and on the other hand would bring the life of the tools below an economically justifiable level. In addition, known mechanical pencils employ several different detachable thread connections and such types of thread connections are also relatively expensive to produce and have the effect of requiring considerably greater assembly time.

In accordance with the present invention the lead collets consist of at least two collet shells which are joined together along at least one plane surface parallel to the axis of the pencil itself and the collet shells contain partially cylindrical recesses in the mating faces thereof with a radius which is substantially equal to half the lead diameter whereby to define a lead receiving passage. The collet shells are formed of a thermoplastic material and each of the other parts of the pencil can likewise be formed of a plastic material except that the spring is most desirably formed of metal.

In one embodiment of the invention the pencil is designed with the two collet shells extending through an annular opening in the tipe end of the pencil housing in such a way that conically flared end portion of the shells is disposed in engagement with the annular tip end of the housing and to grippingly engage the lead contained within the collet and the flared conical end of the collet is maintained in such engagement by means of a compression spring which acts against a collar carried on the opposite end of the collet member. The collet member extends exteriorly of the housing and a cap extends thereover to join the two mating shells of the collet together and to provide a means for moving the collet member in opposition to the bias of the spring in order to spread the collet jaws to release lead for extensible movement from the collet.

Such a pencil is readily assembled by sliding first one and then the other collet shell through the annular opening at the tip and of the pencil end thereafter moving the two shells into congruence with one another and capping their opposite ends so as to join them together. The spring can be maintained in its assembled relation by sliding a collar over the ends of the collet shells after the second shell is moved into congruence with the first and all of this can be accomplished without providing any threaded connection between any parts and by simply utilizing the annular opening at the tip end of the pencil housing and the single end cap as the means for joining the parts in assembled relation. Roughened surfaces or elastic ribs of one kind or another can be formed at the tip end of the collet shells to provide an additional means for insuring a good frictional grip between the collet jaws and the lead itself.

In another form of the invention, the collet jaws with the conically flared external surfaces may extend only through a clamping ring fitted within the pencil housing rather than through an opening at one end thereof, but the concept of assembly and operation is essentially the same. In this embodiment of the invention, the lead extends further through a tubular opening formed in the tip end of the pencil housing itself and that opening may in itself have elastic ribs of one kind or another to insure a gripping relation between the pencil lead and the housing itself.

In this second embodiment of the invention, the assembly is essentially the same in that the two shells which are to define the collet member itself are placed in face to face engagement with one another but are maintained in a position axially displaced from one another while they are inserted through a clamping ring. The clamping ring has an internal diameter which is smaller than the maximum diameter of the conically flared portion of the collet member (when the two shells are in congruence with one another) but which is greater than the combined cross sectional area of the flared collet shell at its widest point and the necked portion of the adjacent shell so that the two shells (when axially displaced) can be slid through the clamping ring. Thereafter, the two shells are moved into congruence with one another and the end cap at the opposite end of the collet member is placed over the two shell ends in order to maintain the whole arrangement in assembled relation.

It is therefore an important object of the present invention to provide a mechanical pencil of the collet action type wherein the collet member is formed from two mating shells which shells are maintained in assembled relation with a minimum of parts.

It is a further and more particular object of the invention to provide a mechanical pencil of this general type wherein the conically flared end of the collet member extends through an annulus and wherein the opposite end of the shells are maintained together by a cap in order to maintain the two shells in assembled relation with respect to one another.

A further object of the invention resides in the means of assembling a mechanical pencil of the herein described type in such a manner that the collet member can be entirely assembled and put in operative condition without requiring precise machining and without necessitating threading assembly steps.

These and other object, advantages and features of the present invention will become apparent from time to time as the following specification proceeds and with reference to the accompanying drawings wherein:

FIG. 4 is a vertical sectional view through a mechanical pencil constructed in accordance with the principles of this invention but showing another embodiment thereof wherein one end of the collet member is maintained in assembled relation by a clamping ring and the lead extends from the collet member through the tip end of the pencil housing;

FIG. 5 is a horizontal sectional view through the mechanical pencil of FIG. 4 showing various parts during an assembly operation;

FIG. 6 is a view of the assembly process wherein the identically configured collet shells are maintained in axially displaced position with respect to one another as they are inserted through the clamping ring; and FIG. 7 is a fragmentary vertical sectional view through a combined collet member and lead guiding tube.

Figure 1:
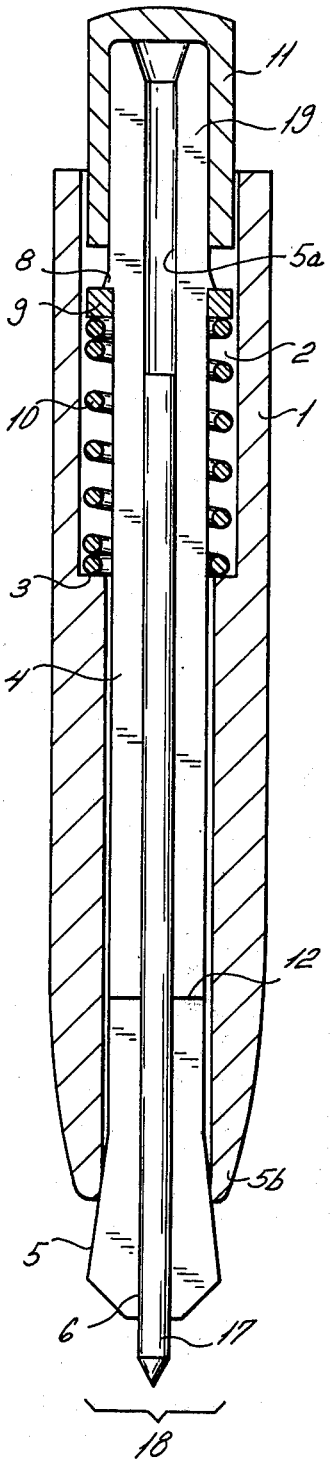
FIG. 1 is a vertical sectional view through a mechanical pencil constructed in accordance with the principles of the present invention.
Figure 2:
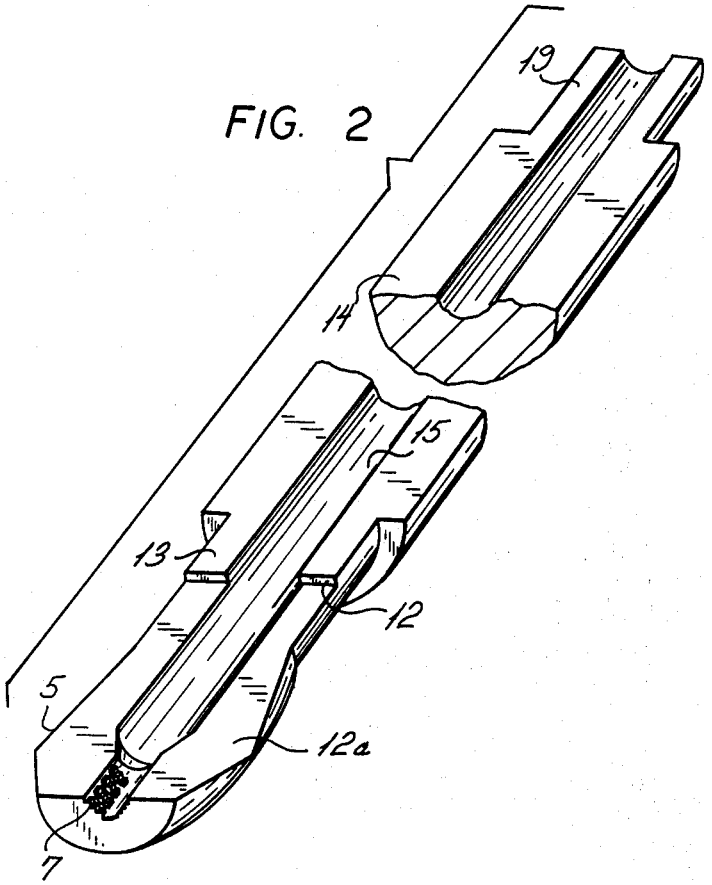
FIG. 2 is a fragmentary perspective view of two collect half shells.
Figure 3:
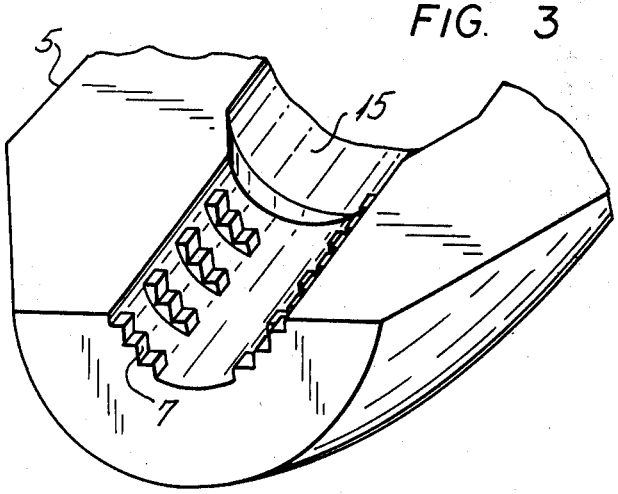
FIG. 3 is a fragmentary perspective view of the gripping surface of a collet shell.

Referring initially to FIG. 1 there is shown a housing 1 having a bore 2 formed therein along the axis thereof which bore has a radially enlarged portion at the upper end thereof and is stepped down as at 3 to a radially reduced tubular section. Into this bore is fitted a collet member indicated generally at 4 and consisting of two identically configured collet half shells. The collet half shells are formed of thermoplastic material and are plastically deformable and have outwardly flared conical end portions 5 and have a lead receiving passage 5*a* formed therein which open through a cylindrically configured slightly radially reduced section 6 thereof which, in turn, is provided with knurls or small ribs or elevations 7 for the purpose of providing an additional gripping effect on the lead 17 carried within the passage 5*a*.

At the upper end of the collet member a slightly outwardly flared collar 8 is provided which is of such a dimension that a slotted supporting ring 9 can be fitted thereover which, in turn, serves as a seat for one end of a compression spring 10 which is adapted to be interposed between the stepped shoulder 3 and the ring 9. It will be observed that when two identically configured collet shells are placed in assembled relation with one another, the spring 10 will serve to bias the flared conical portion of the collet member 4 into engagement with the annular end portion 5*b* of the housing 1 to cause the lower ends of the collet member (constituting the collet jaws to frictionally grip and hold the lead 17 in writing position. The upper end of the two collet half shells are joined together in mated relation by an end closure cap 11 which is simply fitted over the ends of the two collet half shells and serves to hold them in proper assembled relation with respect to one another. The upper end of the collet member and the end closure cap 11 extend exteriorly of the housing 1 in order to provide a means whereby the collet member can be depressed relative to the housing against the opposing bias of the spring 10 to move the conical section 5 out of engagement with the annulus 5*b* in order to cause the collet half shells to spread apart from one another and to permit the lead 17 to drop by gravity to a lower position within the passage 5*a*.

As will be understood by those well skilled in this art, the lower end of the collet half shells are relieved as at 12*a* by small steps 12 in order to provide a means whereby the portions of the collet members below the steps 12 can be moved into engagement with the lead to hold it in fixed position.

Referring now to the embodiment of the invention illustrated in FIG. 4 it will be observed that the housing 20 is cylindrical in configuration and has a separable tip 23 threaded onto the lower end of the housing part 20. A cylindrical bore 21 is formed within the housing 20 and is radially enlarged at the step bore shoulder 22 in order to provide the threaded part into which the tip 23 is fitted.

A plurality of elastic ribs 24 are formed within the interior of the tip 23 surrounding the tubular opening in that tip in order to provide a simple means to frictionally engage the lead 17 and retard or brake its movement through the tip end of the pencil.

In this embodiment of the invention two collet half shells 4 are also provided which are configured identically to one another and which terminate at their lower end in flared conical portions 5 which then are necked down for a distance to the shoulders 14 formed on the collet half shells. The shoulders 14 comprise a single planar seating surface (when the half shells are in assembled relation) in order to provide a seat for one end of the compression spring 10. The compression spring 10 has its opposite or lower end seated, in turn, on a mounting ring 27 which, in turn, is fitted between the shoulder 22 and the innermost end of the tip 23. The upper ends of the collet half shells 4 are joined together by means of an end closure cap 11 which extends over the radially reduced portions 19 of those half shells and which is simply in frictional engagement therewith in order to maintain the upper part of the collet member in assembled relation. The conically flared lower end portion of the collet member extends through a clamping ring 28 and is maintained in engagement with that clamping ring normally by the bias of the spring 10. The tip end 23 is further provided with a shoulder 32 which is spaced downwardly from the normal spring biased position of the end of the collet member in order to provide a stop for the collet member.

In practice, the upper end of the collet member is depressed to move the collet member against the bias of the spring 10 until the lower end of the collet member engages the stop 32 and at such time the conically flared lower end portion of the collet member moves out of engagement with the clamping ring 28 and the collet jaws spread in order to release their grip on the lead 17.

Referring again to FIG. 1 it will be observed that the parts can be assembled in the following manner.

A first collet half shell is placed into the bore 2 of the housing 1 so that it is in a position somewhat further extended from the housing as is illustrated in FIG. 1 with the necked portion of the collet half shell disposed at the annulus **5*b* and the second collet half shell can then be placed down through the tubular opening 2 from the top, and the spring and slotted supporting ring can thereafter be fitted over these two parts. When the first collet half shell is disposed with its necked down portion at the annulus 5*b*, there will be sufficient space at the annulus to permit movement of the conically flared portion of the second collet half shell to move past the annulus. Once the two parts are in congruent relation with respect to one another the spring and slotted supporting ring can then be placed over the collar 8 and the spring compression can then be released in order to return the two collet half shells to the position illustrated in FIG. 1. At such time, the end closure cap 11** can be placed over the upper end portion of the two collet half shells.

The same type of assembly steps can take place with respect to the embodiment of the invention illustrated in FIG. 4. The particular assembly process is well illustrated in FIG. 6 wherein it will be observed that the collet half shell on the left has already been placed through the clamping ring 28 and through the annular mounting ring 27 so that the necked down portion thereof is actually within the annular clamping ring 28. At such point, the second collet half shell (the one on the right) can then be passed down through the annular mounting ring 27 and through the clamping ring 28 until it assumes its proper position in congruence with the other clamping half shell and at such time the spring compression can be released and the two mating parts will then move to the position illustrated in FIG. 4. Since no counterpart for the slotted supporting ring is located at the upper end of the collet member 4 in the embodiment of the invention illustrated in FIG. 4, the end closure cap 11 serves the purpose of maintaining the collet half shells in assembled relation.

By means of the particular design of these parts, it is possible to produce collets of plastic which in the past were made of metal. By means of designing the collet member so that is consists only of two identically configured parts, it is possible to construct a collet member without a complicated core and to utilize a simple modling technique.

In order to assemble collets produced in accordance with this invention the parts need to be axially shifted with respect to one another as they are inserted through the annulus which ultimately maintains the lower ends of the collet half shells in assembled relation. Utilization is also made of the fact that each individual part has a certain elasticity which makes it possible to pass a part of a larger diameter through a bore whereby either the bore itself, the collet parts, or both parts change their shape elastically for a short period of time while the parts are assembled.

These two measures, that is the design of the collets and the method for the assembly of the collet halves create further possibilities for the production of mechanical pencils which consist of a minimum of parts and which furthermore can be manufactured easily of suitable plastically deformable materials. Still further, by means of producing the collet halves in an injection molding process, the gripping surfaces for the lead can be designed particularly advantageously and this is not generally true in connection with metal collets consisting of a single molded piece.

It will be understood that these embodiments of the invention have been described for illustrative purposes only and that various modifications and variations in the invention may be made without departing from the spirit and scope of the novel concepts thereof.

I claim as my invention:

1. A method of assembling a lead feed collet from a resiliently deformable clamping ring formed of plastic material and having a predetermined internal diameter, and from a pair of identical and interfittable collet half shells formed of high-strength resilient plastic material and each having a flared end portion, a semi-cylindrical end portion, and an intermediate portion between said end portions, each of said half shells having a flat face fittable against the flat face of the other half shell, said flared end portions forming with said faces lying flatly against each other a generally frustoconical surface at its widest portion of an outer diameter substantially greater than said inner diameter, said intermediate portions forming with said faces lying flatly against each other an outer surface of an outer diameter smaller than said inner diameter and said semicylindrical end portions forming with said faces lying flatly against each other a generally cylindrical surface with an outer diameter substantially greater than said inner diameter and than said outer diameters of said frustoconical surface, said method comprising the steps of: passing one of said flared end portions of one of said half shells through said ring while deforming said ring and without substantial deformation of said one flared end portion and positioning said ring around the intermediate portion of said one half shell; thereafter sliding the other half shell with its flat face along said one half shell and simultaneously passing the flared end portion of said other half shell through said ring with deformation thereof but without substantial deformation of said flared end of said other half shell; and thereafter aligning said half shells with their end and intermediate portions next to each other and said ring surrounding said intermediate portions.

2. The method defined in claim 1, further comprising the steps of prior to sliding said ring over said one flared end portion; sliding a coil spring over said one flared end portion and positioning said spring around said intermediate portion of said one half shell; and thereafter sliding over said one flared end portion a rigid ring having an inner diameter greater than said outer diameter of said frustoconical surface and compressing said spring against the shoulder formed by said semicylindrical portion of said one half shell with said rigid ring.

3. The method defined in claim 1 wherein said ring is normally of cylindrical shape and is only deformed during passing of said flared end portions through itself by being diametrically flattened.

4. The method defined in claim 1, further comprising the step of after aligning said half shells placing a cap onto the aligned semicylindrical end portions.

* * * * *